US010190750B1

(12) United States Patent
Clements et al.

(10) Patent No.: US 10,190,750 B1
(45) Date of Patent: Jan. 29, 2019

(54) TROFFER LUMINAIRE WITH AN ARCHED LENS

(71) Applicant: Cooper Technologies Company, Houston, TX (US)

(72) Inventors: Steven Russell Clements, Atlanta, GA (US); Rusty Brandon Flippo, Newnan, GA (US)

(73) Assignee: COOPER TECHNOLOGIES COMPANY, Atlanta, GA (US)

( * ) Notice: Subject to any disclaimer, the term of this patent is extended or adjusted under 35 U.S.C. 154(b) by 25 days.

(21) Appl. No.: 15/364,934

(22) Filed: Nov. 30, 2016

Related U.S. Application Data

(60) Provisional application No. 62/260,916, filed on Nov. 30, 2015.

(51) Int. Cl.

| | |
|---|---|
| ***F21V 7/00*** | (2006.01) |
| ***F21V 13/04*** | (2006.01) |
| ***F21S 8/02*** | (2006.01) |
| ***F21V 15/01*** | (2006.01) |
| ***F21V 3/02*** | (2006.01) |
| *F21V 23/00* | (2015.01) |
| *F21V 23/02* | (2006.01) |

(52) U.S. Cl.
CPC ..... *F21V 13/04* (2013.01); *F21S 8/026* (2013.01); *F21V 3/02* (2013.01); *F21V 7/0025* (2013.01); *F21V 15/01* (2013.01); *F21V 23/002* (2013.01); *F21V 23/023* (2013.01)

(58) Field of Classification Search
CPC ..... F21V 13/04; F21V 3/02; F21V 7/0025; F21V 15/01; F21V 23/002; F21V 23/023; F21S 8/026
See application file for complete search history.

(56) References Cited

U.S. PATENT DOCUMENTS

| | | | | |
|---|---|---|---|---|
| 5,172,976 | A * | 12/1992 | Bogdanovs | F21V 17/107 362/223 |
| 7,204,603 | B1 * | 4/2007 | Lanczy | F21S 8/06 362/148 |
| D608,490 | S * | 1/2010 | Chung | D26/118 |
| 7,862,199 | B2 * | 1/2011 | Ladstatter | F21S 8/02 362/147 |
| 7,950,833 | B1 * | 5/2011 | Crane | F21S 8/02 362/319 |
| 8,038,318 | B2 * | 10/2011 | Plunk | F21S 8/02 362/217.11 |
| 8,702,264 | B1 * | 4/2014 | Rashidi | F21S 8/026 362/147 |
| 9,488,348 | B2 * | 11/2016 | Scribante | F21S 8/026 |

(Continued)

OTHER PUBLICATIONS

Lithonia Lighting; 2FSL2 2x2 LED, Product Specification; Sep. 22, 2016.

(Continued)

*Primary Examiner* — Tsion Tumebo
(74) *Attorney, Agent, or Firm* — King & Spalding LLP

(57) ABSTRACT

A troffer luminaire includes a housing and a door attached the housing. The door includes a first end plate and a second end plate. Disposed between the first and second end plates are a first reflector that has a first flange and a second reflector that has a second flange. The edges of a flexible lens are disposed in the first flange and the second flange, respectively.

17 Claims, 5 Drawing Sheets

(56) References Cited

U.S. PATENT DOCUMENTS

| | | | | |
|---|---|---|---|---|
| 2002/0003698 | A1* | 1/2002 | Engel | F21S 8/04 362/224 |
| 2007/0211457 | A1* | 9/2007 | Mayfield, III | F21S 8/02 362/223 |
| 2007/0253205 | A1* | 11/2007 | Welker | F21S 8/02 362/373 |
| 2010/0091484 | A1* | 4/2010 | Mayfield, III | F21S 8/026 362/223 |
| 2012/0155073 | A1* | 6/2012 | McCanless | F21S 8/04 362/218 |
| 2014/0126195 | A1* | 5/2014 | Dixon | F21S 8/026 362/218 |
| 2014/0146542 | A1* | 5/2014 | Seward | F21V 17/18 362/297 |
| 2014/0268759 | A1* | 9/2014 | Vang | F21K 9/50 362/240 |
| 2016/0091181 | A1* | 3/2016 | Scribante | F21S 8/026 362/220 |

OTHER PUBLICATIONS

Metalux, Cruze, Recessed LED luminaire; Eaton; Product Brochure, Feb. 29, 2016.

* cited by examiner

TROFFER LUMINAIRE WITH AN ARCHED LENS

RELATED APPLICATIONS

The present application claims priority under 35 U.S.C. § 119 to U.S. Provisional Patent Application No. 62/260,916, titled "Troffer Luminaire With An Arched Lens," and filed on Nov. 30, 2015, the entire contents of which are incorporated herein by reference.

TECHNICAL FIELD

The disclosed embodiments relate generally to troffer luminaires and specifically to troffer luminaires with an arched lens.

BACKGROUND

Troffer luminaires often comprise a door that is hinged to an upper housing of the luminaire. Such luminaires also often comprise a flat lens disposed within an opening in the door. The flat lens diffuses light emitted from the troffer luminaire. There is a need for a troffer luminaire that will accommodate an arched lens instead of a flat lens.

SUMMARY

In general, in one aspect, the disclosure relates to a troffer luminaire comprising an upper housing and a hinged door. The hinged door comprises first and second end plates and first and second reflectors disposed between the end plates. The first reflector and the second reflector comprise first and second flanges respectively. The first flange and second flange are separated by a distance. The toffer luminaire further comprises a flexible lens disposed between the first flange and the second flange, wherein the flexible lens has a width that is wider than the distance so that when the flexible lens is disposed between the first flange and the second flange, the flexible lens bends into an arched shape.

In another aspect, the disclosure relates to a troffer luminaire comprising an upper housing and a door. The door comprises first, second, third, and fourth side members defining an opening through which light emitted from the troffer luminaire passes. The door further comprises a first end plate, a second end plate, a first reflector attached to the first side member and extending between the first end plate and the second end plate, and a second reflector attached to the second side member and extending between the first end plate and the second end plate. A first flange is attached to the first reflector and a second flange is attached to the second reflector and a flexible lens is disposed between the first and second flanges.

These and other aspects, objects, features, and embodiments will be apparent from the following description and the appended claims.

BRIEF DESCRIPTION OF THE DRAWINGS

The following drawings accompany the present disclosure.

Figure 1:
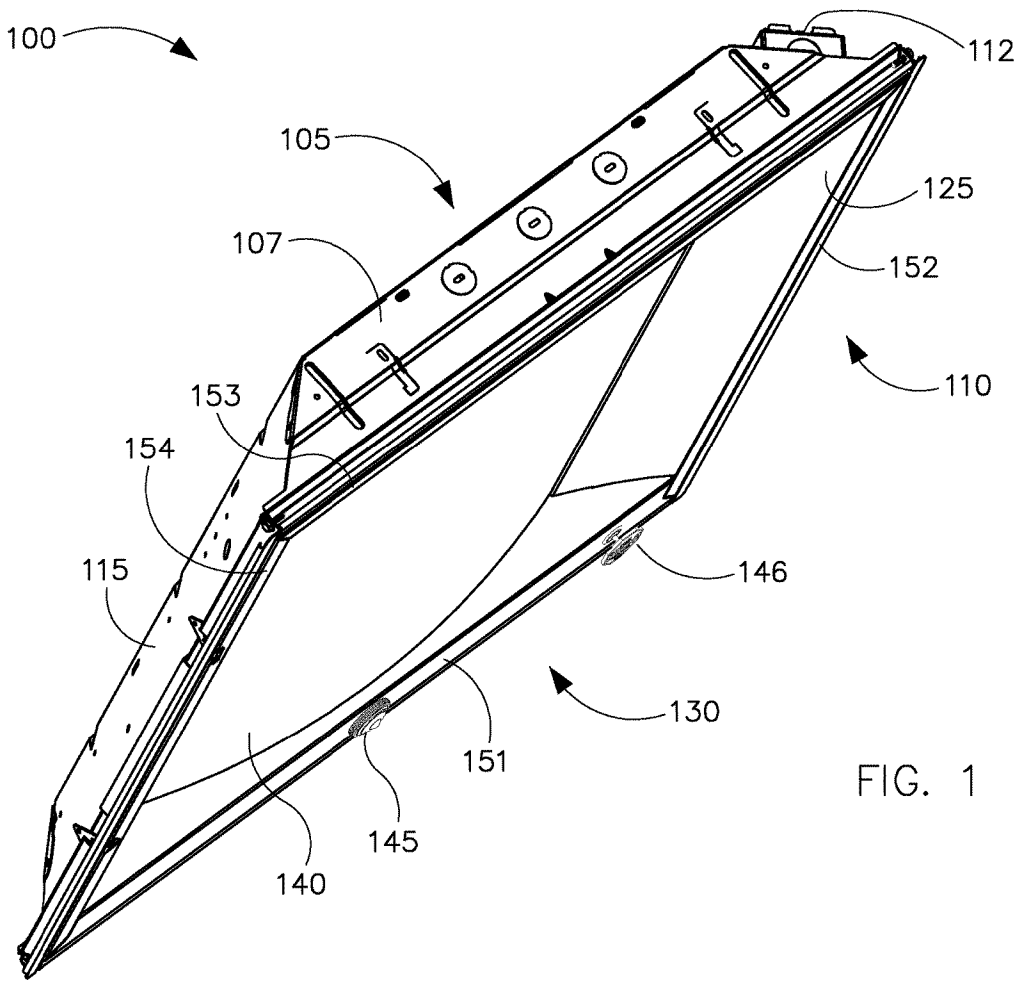
FIG. 1 shows a perspective view of a troffer luminaire in accordance with an example embodiment of the present disclosure.

The drawings illustrate only example embodiments of the disclosure and are therefore not to be considered limiting of its scope, as the disclosure may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION OF EXAMPLE EMBODIMENTS

Example embodiments disclosed herein are directed to troffer luminaires with an arched lens. However, those of skill in the field will recognize that the teachings described herein can be applied to a variety of luminaires. The present disclosure will be described in further detail by way of examples with reference to the accompanying drawings. In the description, well-known components and methods are omitted or only briefly described so as not to obscure the disclosure. As used herein, the "present disclosure" refers to any one of the example embodiments described herein and any equivalents. Furthermore, reference to various features of the "present disclosure" is not to suggest that all embodiments must include the referenced features.

Figure 2:
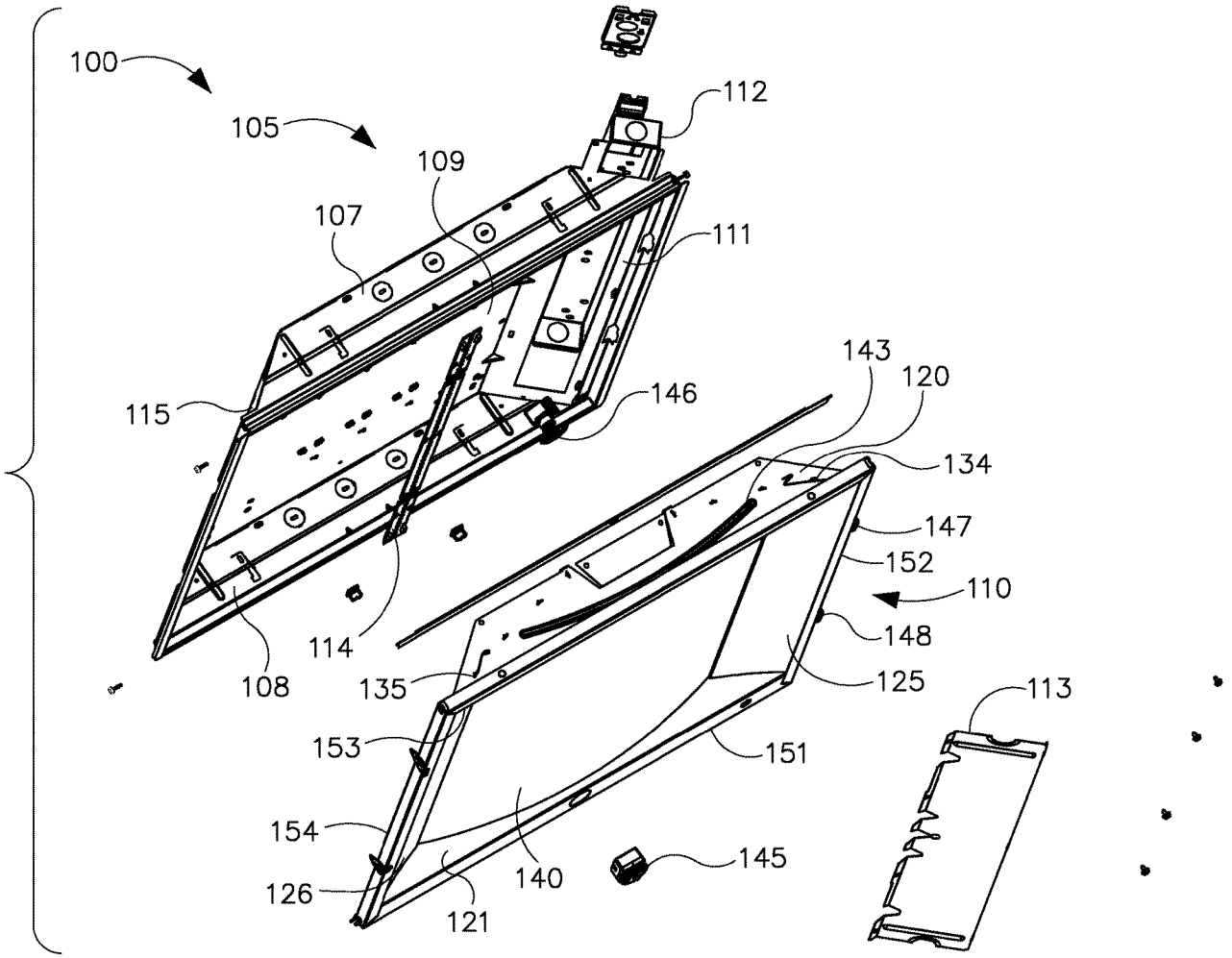
FIG. 2 shows an exploded view of the troffer luminaire of FIG. 1.
Figure 3:
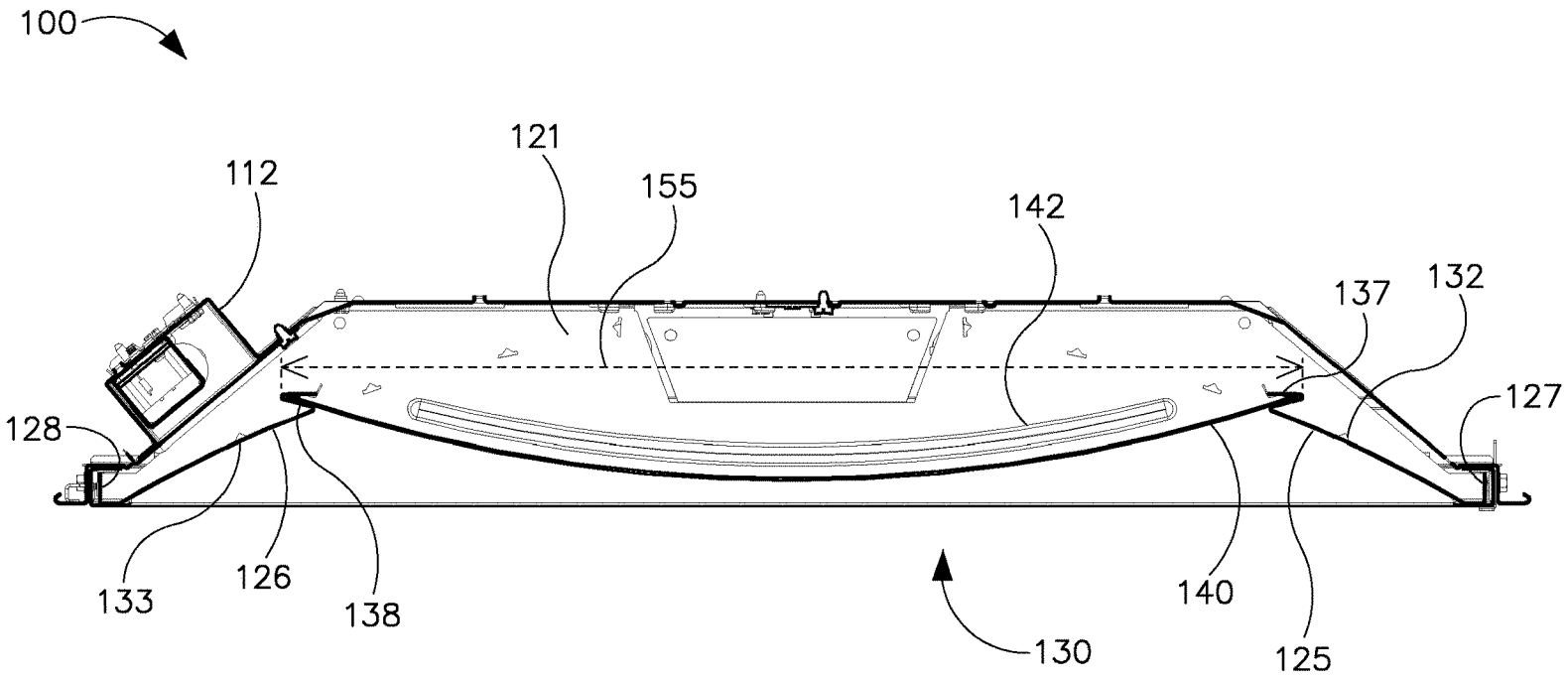
FIG. 3 shows a cross-section view of the troffer luminaire of FIG. 1.
Figure 4:
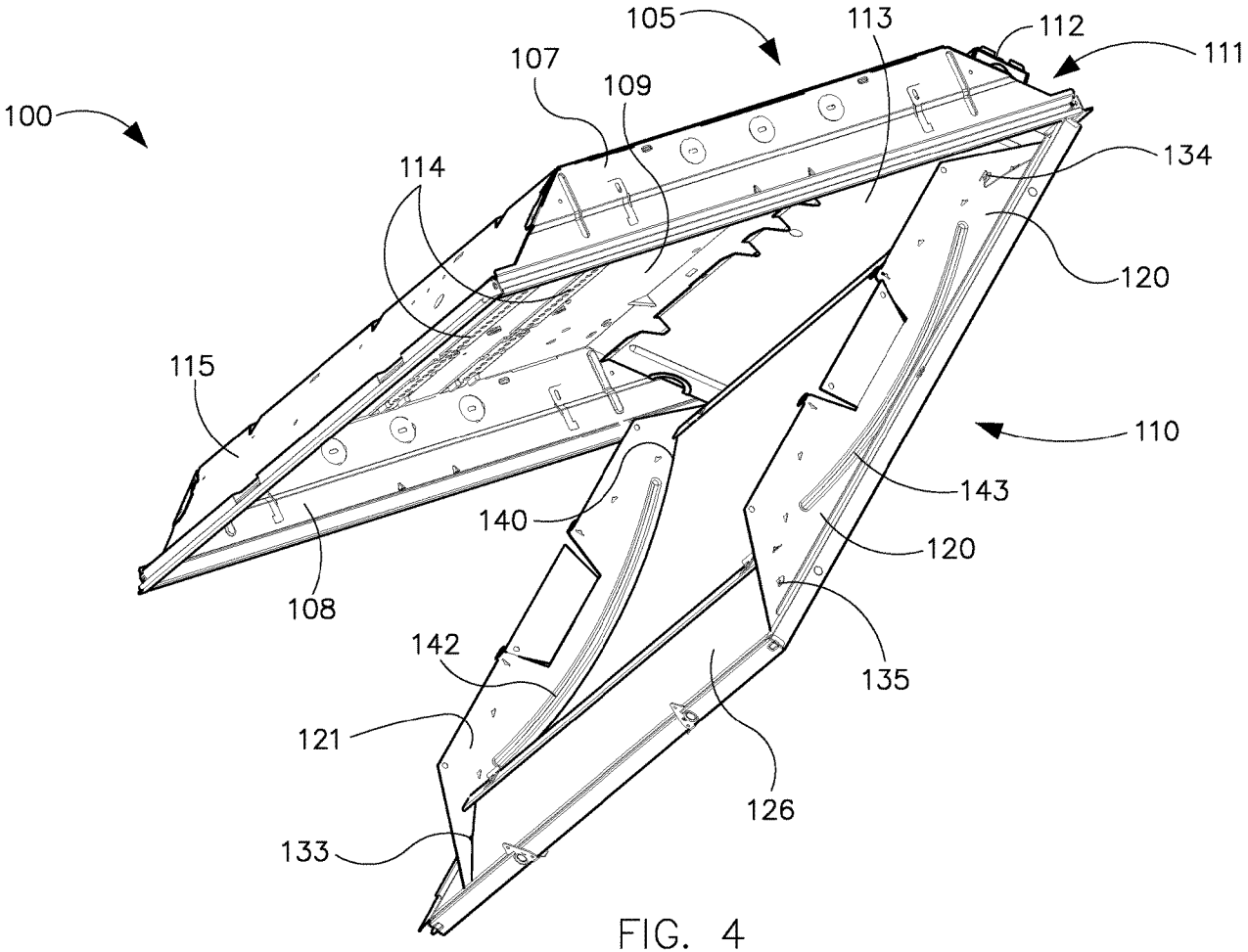
FIG. 4 shows a perspective view of the troffer luminaire of FIG. 1, but with the hinged door in an open position.

FIGS. 1, 2, 3 and 4 show one example embodiment of a troffer luminaire according to the present disclosure. FIG. 1 shows a perspective view of the troffer luminaire with the door closed. FIG. 2 shows an exploded perspective view of the troffer luminaire. FIG. 3 shows a cross-section of the troffer luminaire when the door is closed. FIG. 4 shows a perspective view of the troffer luminaire with the door in an open position. Troffer luminaires are typically installed within a recess in a ceiling.

Referring now to FIGS. 1-4, the example troffer luminaire 100 comprises an upper housing 105 and a door 110 hinged to one side of the upper housing 105. The upper housing comprises housing end plates 107 and 108, a housing back panel 109, and angled side panels 111 and 115. Mounted on angled side panel 111 is a box 112 containing a driver that can supply power to light sources within the troffer luminaire 100. Angled side panel 111 can also comprise apertures for mounting the box 112 to angled side panel 111 and for permitting wiring to pass from the box 112 into the troffer luminaire 100. FIG. 2 shows a cover plate 113 that mounts to the inside surface of angled side panel 111. The example troffer luminaire 100 shown in FIGS. 1-4 comprises LED light sources 114 mounted to the inner surface of the housing back panel 109. In alternate embodiments, other types of light sources can be used within the troffer luminaire including fluorescent light sources and organic LED light sources.

FIGS. 1 and 2 also illustrate a sensor 145 and a test switch 146 mounted in the troffer luminaire 100 through apertures in the door 110. The sensor 145 can be one or more sensors such as a motion sensor or a photo sensor. The test switch 146 can be used, for example, to test a battery back up power source for the troffer luminaire. The sensor 145 and the test switch 146 can be connected via wiring to electrical components, such as the driver, in the box 112.

Referring now to the door 110 that is hinged to one side of the upper housing 105, the door comprises a first end plate 120 and a second end plate 121. The door 110 further comprises first, second, third, and fourth side members 151, 152, 153, and 154, respectively, which define opening 130 of the troffer luminaire 100. Light is emitted from light sources within the housing 105, through the lens 140, and the light exits the luminaire through opening 130. When the door is in the closed position as shown in FIG. 1, the first end plate 120 and the second end plate 121 fit inside the upper housing 105. The door 110 is hinged to the upper housing 105 via hinges 147 and 148 so that the door can be moved to the open position shown in FIG. 4, which permits access to the interior of the troffer luminaire 100 for installation, maintenance and repair. It should be understood that in alternate embodiments the door can be attached to the housing using other types of fasteners instead of hinges. For example, in an alternate embodiment, the door can be attached to the housing using screws such that the door is completely detached from the housing during installation, maintenance or repair.

The door 110 comprises first reflector 125 and second reflector 126. First and second reflectors 125 and 126 are disposed within the door 110 at an angle to the horizontal plane defined by opening 130 in the door 110. The first and second reflectors 125 and 126 comprise attachment features 127 and 128 for attaching the reflectors along the second and fourth side members 152 and 154 of the door 110. For example, the attachment features 127 and 128 can be U-shaped and can be attached to the door 110 with fasteners. In alternate embodiments, the attachment features 127 and 128 can have a different shape and can be attached to the door by snaps, tabs, or other types of fastening mechanisms. The first reflector 125 and second reflector 126 can also comprise tabs that fit into openings in the first end plate 120 and the second end plate 121, such as openings 132, 133, 134, and 135. The first reflector 125 and the second reflector 126 each have a width extending from the second and fourth side members 152 and 154, respectively. The first reflector and second reflector 126 also each have a length extending between the first end plate 120 and the second end plate 121.

The first reflector 125 and the second reflector 126 also comprise a flange on the inner edge of each reflector for holding a flexible lens. In the example embodiment shown in FIGS. 1-4, the first reflector 125 comprises first flange 137 and the second reflector 126 comprises second flange 138. Example flanges 137 and 138 have an S shape designed to receive the edges of flexible lens 140. The distance 155 between first flange 137 and second flange 138 is smaller than the width of the flexible lens 140 so that when the edges of the flexible lens 140 are placed in flanges 137 and 138, the flexible lens 140 is forced to bend in a direction towards opening 130 as shown in FIGS. 1-4. Flexible lens 140 should have a thickness that permits bending of the lens into the desired arch shape, but should be of sufficient thickness to provide rigidity so that the lens does not fall out of flanges 137 and 138. As one example, the flexible lens 140 can be made of acrylic and have a thickness of 0.040 inches. In alternate embodiments, the lens can be made of other materials and have different thicknesses.

Light emitted from a light source within the troffer luminaire 100 passes through the lens 140 and exits the troffer luminaire 100 through opening 130. Light passing through the lens 140 at a high angle will reflect off reflectors 125 and 126 and be directed through opening 130. In some examples, there may be a small gap between the end plates 120 and 121 and the edges of the flexible lens 140 that are closest to the end plates 120 and 121. To prevent light from exiting through this gap between the end plates and the edges of the flexible lens, the example embodiment shown in FIGS. 1-4 includes embossments 143 and 142 on first end plate 120 and second end plate 121, respectively. As shown in FIGS. 2 and 3, the embossments 142 and 143 protrude toward the inner portion of the troffer luminaire 100 and are located above the flexible lens 140. Alternate embodiments of the troffer luminaire 100 may include embossments having a different shape or may omit the embossments.

Figure 5:
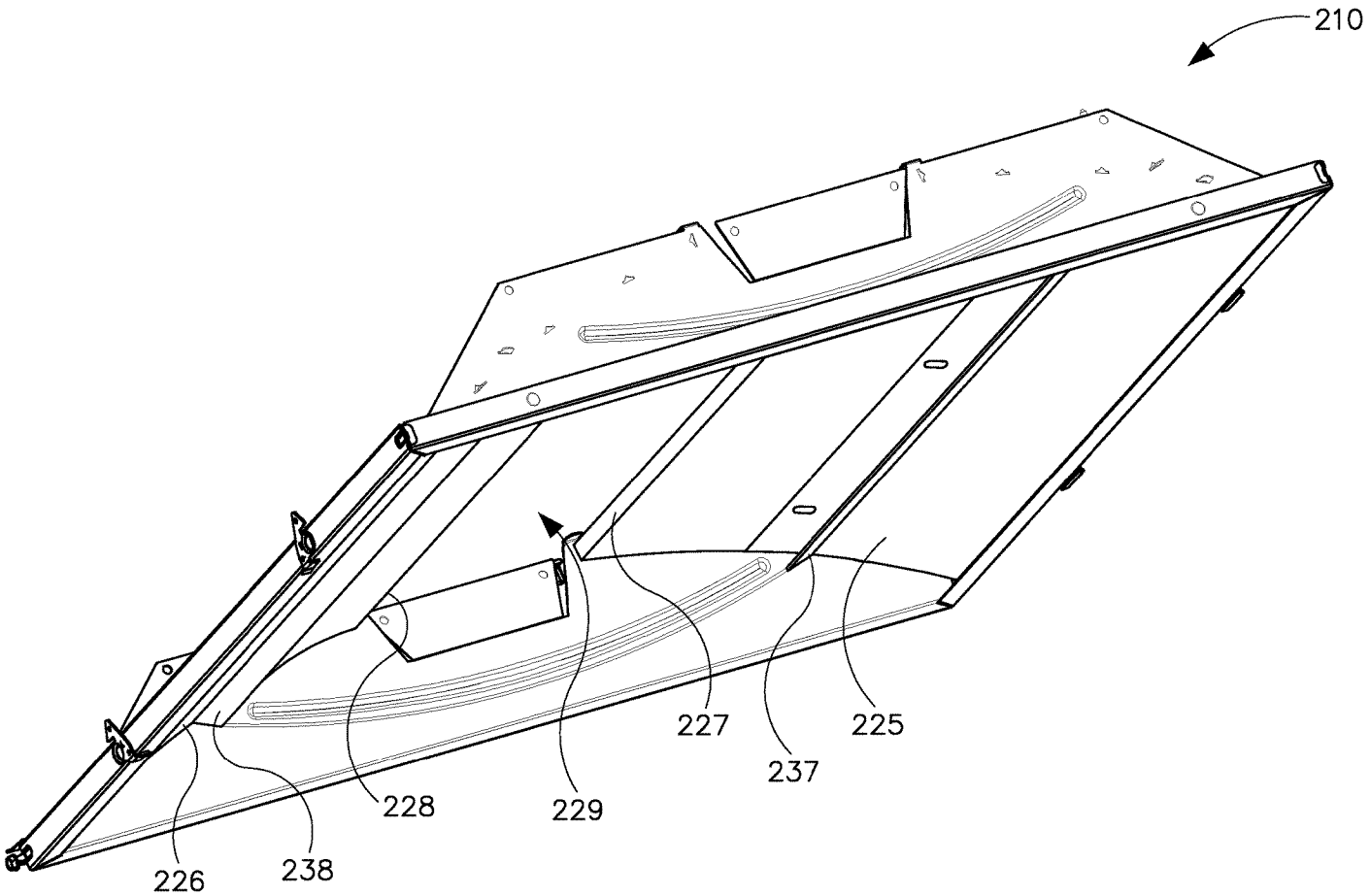
FIG. 5 shows a perspective view of a door for a troffer luminaire in accordance with another example embodiment of the present disclosure.

FIG. 5 illustrates another example embodiment of a door 210 for a troffer luminaire in accordance with the present disclosure. Door 210 provides an alternate door that could be used in a troffer luminaire in place of door 110 shown in FIGS. 1-4. Door 210 is similar to door 110 in that it has similar end plates, embossments, side members, and hinges and the details of these components are the same and will not be repeated. However, door 210 differs from door 110 in that first reflector 225 and second reflector 226 are wider than reflectors 125 and 126 illustrated in FIGS. 1-4. First reflector 225 and second reflector 226 have inner edges 227 and 228, respectively. Inner edges 227 and 228 define an opening 229 through which light can pass from light sources within the housing of the troffer luminaire. A further difference in door 210 is that flanges 237 and 238 are attached at approximately the midpoints of reflectors 225 and 226 using fasteners. Therefore, in contrast to flanges 137 and 138 of FIGS. 1-4, which are located at the inner edges of reflectors 125 and 126, flanges 237 and 238 of FIG. 5 are fastened at positions along the surface of reflectors 225 and 226. Flanges 237 and 238 form a V shape to receive edges of a lens. Although a lens is not shown in FIG. 5, flanges 237 and 238 are designed to hold the edges of a flexible lens so that the lens will be arched in a similar manner to the lens 140 shown in FIGS. 1-4.

The present disclosure describes example embodiments and it should be appreciated by those skilled in the art that various modifications are well within the scope of the disclosure. For example, a flexible arched lens could be implemented in another embodiment of a troffer luminaire that does not utilized a detachable or hinged door. For example, the housing and the door of the troffer luminaire could form a single structure with flanges that receive a flexible lens that is arched when inserted into the luminaire.

From the foregoing, it will be appreciated that an embodiment overcomes the limitations of the prior art. Those skilled in the art will appreciate that the embodiments are not limited to any specifically discussed application and that the embodiments described herein are illustrative and not restrictive. From the description of the example embodiments, equivalents of the elements shown therein will suggest themselves to those skilled in the art, and ways of constructing other embodiments will suggest themselves to practitioners of the art.

The invention claimed is:

1. A troffer luminaire comprising:

an upper housing;

a door hinged to a side of the upper housing and defining an opening of the troffer luminaire, wherein the door comprises:

a first end plate and a second end plate disposed opposite to the first end plate;

a first reflector disposed between the first end plate and the second end plate, the first reflector comprising a first flange;

a second reflector disposed between the first end plate and the second end plate, the second reflector comprising a second flange; and a flexible lens that is bound by a first edge, a second edge that is opposite to the first edge, a third edge that is disposed between a first end of the first edge and a first end of the second edge, and a fourth edge that is opposite to the third edge and disposed between a second end of the first edge and a second end of the second edge, wherein the flexible lens is disposed between the first flange and the second flange of the door such that the first edge of the flexible lens engages the first flange, the second edge of the flexible lens engages the second flange, the third edge is disposed adjacent the first end plate, and the fourth edge is disposed adjacent the second end plate, the flexible lens having a width between the first edge and the second edge that requires the flexible lens to bend when disposed between the first flange and the second flange such that the third edge and the fourth edge of the flexible lens are curved when the flexible lens is disposed between the first flange and the second flange, wherein when the flexible lens is disposed in the door, a first gap exists between the first end plate and the third edge of the flexible lens and a second gap exists between the second end plate and the fourth edge of the flexible lens, wherein the first end plate of the door comprises a first embossment that obstructs light from exiting the luminaire through the first gap and the second end plate of the door frame comprises a second embossment that obstructs the light from exiting the luminaire through the second gap, wherein the first embossment and the second embossment protrude into the opening, and wherein the first embossment and the second embossment are positioned such that when the flexible lens is disposed in the door, the first embossment and the second embossment are disposed above the flexible lens and follow a curve of the third edge and the fourth edge of the flexible lens, respectively.

2. The troffer luminaire of claim 1, wherein the upper housing comprises an LED light source.

3. The troffer luminaire of claim 2, wherein the the flexible lens is disposed in the opening of the door.

4. The troffer luminaire of claim 3, wherein the light is emitted by the LED light source, and wherein the light emitted from the LED light source exits the troffer luminaire through the opening.

5. The troffer luminaire of claim 1, wherein the first flange and the second flange comprise an S shape for retaining the flexible lens.

6. The troffer luminaire of claim 1, wherein the first flange and the second flange comprise a V shape for retaining the flexible lens.

7. The troffer luminaire of claim 1, wherein the first flange is disposed on an inner edge of the first reflector and the second flange is disposed on an inner edge of the second reflector.

8. The troffer luminaire of claim 1, wherein the first flange is fastened to the first reflector and the second flange is fastened to the second reflector.

9. The troffer luminaire of claim 1, wherein a distance between the first flange and the second flange is shorter than the width of the flexible lens.

10. The troffer luminaire of claim 1, further comprising one or more of a sensor and a test switch disposed in an aperture in a side member of the door.

11. A troffer luminaire comprising:

an upper housing;

a door configured to fit within the upper housing, wherein the door comprises:

a first side member, a second side member, a third side member, and a fourth side member which define an opening in the door through which light from the troffer luminaire passes;

a first end plate and a second end plate disposed opposite to the first end plate;

a first reflector attached to the first side member and extending between the first end plate and the second end plate;

a first flange attached to the first reflector;

a second reflector that is disposed opposite to the first reflector and attached to the second side member, the second reflector extending between the first end plate and the second end plate;

a second flange attached to the second reflector; and a flexible lens disposed between the first flange and the second flange, the flexible lens have a width that is greater than a distance between the first flange and the second flange, wherein the first end plate comprises a first embossment that protrudes into the opening and towards the second end plate, and the second end plate comprises a second embossment that protrudes into the opening and towards the first end plate, the first embossment and the second embossment configured to obstruct light from exiting the luminaire through gaps in between edges of the flexible lens and the first and second end plates, and wherein the first embossment and the second embossment are positioned such that when the flexible lens is disposed between the first flange and the second flange of the door, the first embossment and the second embossment are disposed above the flexible lens and follow at least a portion of a curve of the edges of the flexible lens.

12. The troffer luminaire of claim 11, wherein the first flange and the second flange comprise an S shape for retaining the flexible lens.

13. The troffer luminaire of claim 11, wherein the first flange and the second flange comprise a V shape for retaining the flexible lens.

14. The troffer luminaire of claim 11, wherein the first flange is fastened at a midpoint of the first reflector and the second flange is fastened at a midpoint of the second reflector.

15. The troffer luminaire of claim 11, wherein the door is attached to the upper housing with hinges.

16. The troffer luminaire of claim 11, wherein the door is attached to the upper housing with fasteners.

17. The troffer luminaire of claim 11, further comprising one or more of a sensor and a test switch disposed in an aperture in the third side member of the door.

* * * * *